United States Patent [19]

Worswick

[11] 4,182,453

[45] Jan. 8, 1980

[54] RACK FOR DISPLAYING AND SECURING GUNS

[76] Inventor: Alan Worswick, 18 Mavis Rd., Blackburn, Lancashire, England

[21] Appl. No.: 893,019

[22] Filed: Apr. 3, 1978

[30] Foreign Application Priority Data

Apr. 1, 1977 [GB] United Kingdom ..... 13964/77

[51] Int. Cl.[2] ..... E05B 73/00; A47F 7/00

[52] U.S. Cl. ..... 211/4; 211/64; 248/203

[58] Field of Search ..... 211/4–8, 211/64, 60; 248/203; 70/403, 259, 371

[56] References Cited

U.S. PATENT DOCUMENTS

| | | | |
|---|---|---|---|
| 2,710,100 | 6/1955 | Vermillion | 211/4 |
| 3,419,728 | 12/1968 | Wilson | 211/4 X |
| 3,637,180 | 1/1972 | Parry | 211/64 X |
| 4,088,228 | 5/1978 | Schwalbe | 211/4 |

*Primary Examiner*—Thomas J. Holko

*Attorney, Agent, or Firm*—Fleit & Jacobson

[57] ABSTRACT

A rack for displaying and securing guns has a bar which is secured to a wall and a number of gun supports attached to the bar. When guns are in place on a support, the fastenings securing the bar to the wall, and the fastenings attaching the gun supports to the bar are hidden. A locking pin passes through the trigger guard of each gun and is locked in a recess in the base. A common locking mechanism can lock all the pins on one rack.

5 Claims, 3 Drawing Figures

RACK FOR DISPLAYING AND SECURING GUNS

This invention relates to a rack for displaying and securing guns.

Although it is desirable to display guns such as shotguns and rifles, it is becomingly increasingly important to ensure that the guns are safe from theft. Potential thieves fall into two categories. Those who see the guns as objects of value, and those who would use the gun as a weapon, e.g. for robbery.

According to the invention, there is provided a rack for displaying and securing guns, which rack comprises a base having holes for receiving fastenings for securing it to a wall, a gun support attached to the base for receiving the fore-end of a gun, the holes being inaccessible when a gun is in place on the support, and a locking-pin which can be inserted through the trigger guard of the gun into a recess in the base where it can be locked, the pin having a head shaped so that the gun cannot be withdrawn once the pin is locked in its recess.

Preferably, the gun support can be swivelled so that all the guns on a particular rack can be correctly aligned.

Preferably, the gun support extends underneath the gun so as to prevent access to the screws which secure the trigger-guard.

The base may consist of a first member to be screwed to a wall, and a second cover member which is secured to the first member by the screws which attach the gun support to the base.

Preferably, the first member has a rebate along one edge, and the cover member fits over the first member to leave a space extending along the rack adjacent the rebated edge. A locking bar is received partly in the rebate and partly in the space. The bar has notches cut out of one edge at regular intervals along it, and the locking pins have annular grooves so that when a pin is inserted through the cover plate, its annular groove is in the space. For inserting a pin, the locking bar is moved so that a notch registers with the hole for the pin, and for locking the pin, the bar is moved so that its unnotched edge engages in the groove.

A common locking-bar can lock a number of locking-pins to hold a number of guns in place on one rack.

The rack may incorporate an alarm-device operated by a micro-switch which is opened or closed by movement of the bar in the slot. The alarm can be wired to a main alarm system of the house. The bar can be secured against movement by any suitable locking mechanism.

The invention will now be further described by way of example, with reference to the accompanying drawings, in which.

Figure 1:
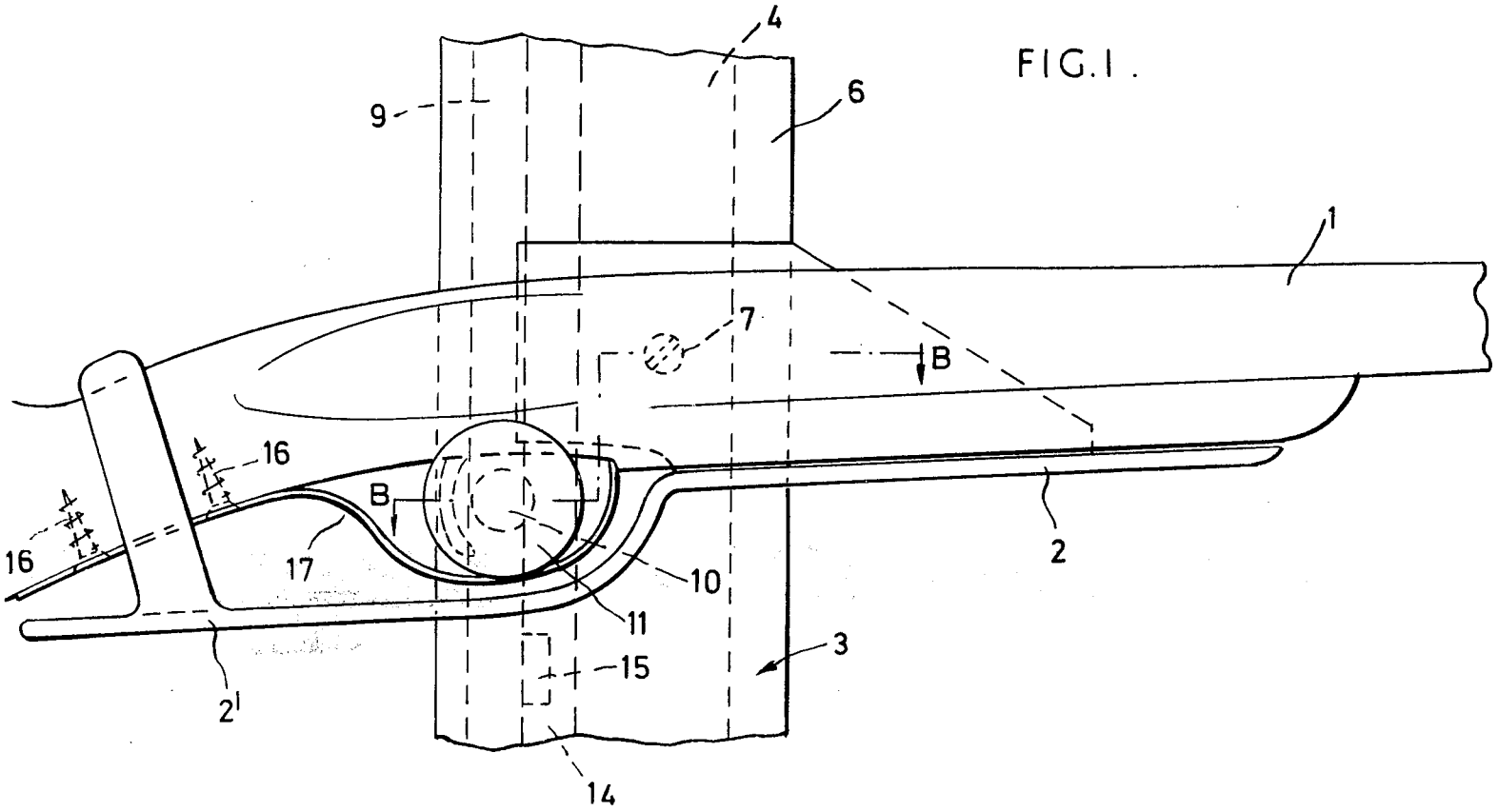
FIG. 1 is an elevation showing a gun in the locked position on a section of a rack according to the invention.

In FIG. 1, a gun 1 rests on a platform 2 attached to a base generally indicated by 3.

Figure 2:
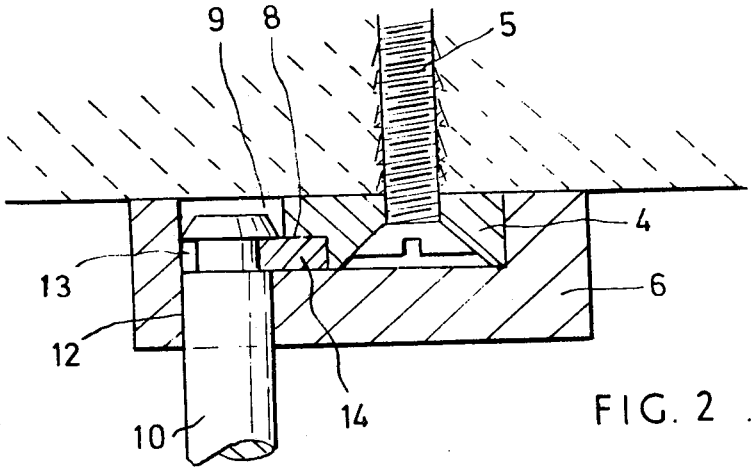
FIG. 2 is a section of the rack of FIG. 1 showing how the rack is fixed to a wall.
Figure 3:
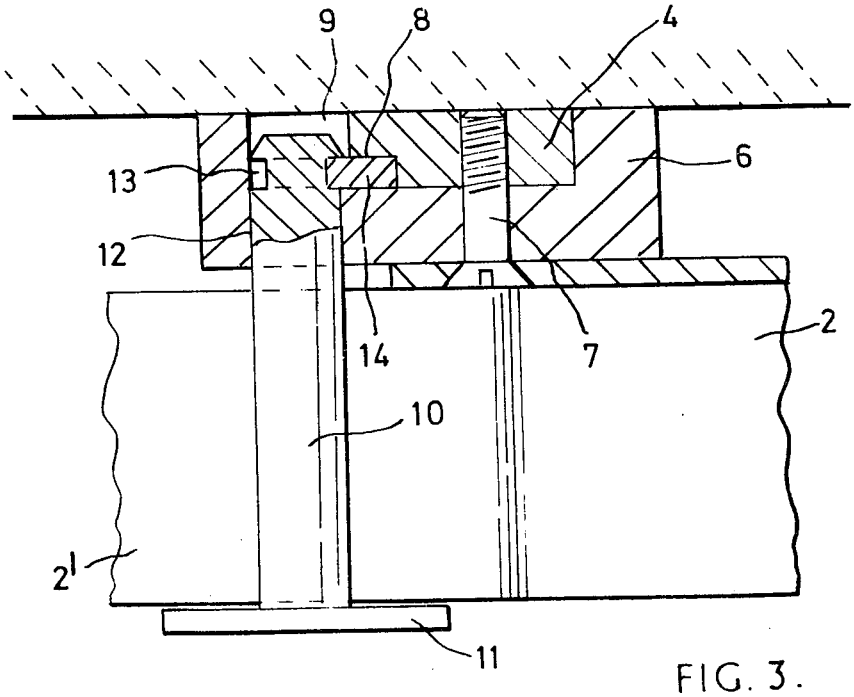
FIG. 3 is a section through FIG. 1 on the lines B—B, omitting the gun.

The construction of the base will first be more clearly described with reference to FIGS. 2 and 3. A mild steel plate 4 is securely bolted to the wall by means of expanding Rawlbolts 5 or similar methods. A cover 6 has a recess on its rear face, so that it will fit over the plate 4. The cover 6 is secured to the plate 4 by means of a number of counter-sunk head set-screws 7 which pass through the cover 6 into the plate 4. The base 3 is thus fixed to the wall, and the main fixing screws 5 are concealed by the cover 6.

Each gun support or platform 2 is attached to the cover 6 by means of the set screws 7. This is the only attachment to each platform, and therefore by slightly slackening the screw, the platform can be pivoted to alter the alignment of the barrels of the gun resting on that support. When the gun is in place, the set-screw 7 is concealed by the central part of the gun, so that it can not be unscrewed.

A locking-pin 10 has a head 11. The shank of this pin passes through the trigger guard of the gun, but the head 11 is so large that it would not pass through the guard, and the guard will not be able to pass back over it. The manner in which locking of the pins 10 is achieved will now be described.

A rebate 8 is formed on one edge of the plate 4. When the cover 6 is fitted over plate 4, it leaves a space 9 running along the length of the rack. A locking nar 14 is retained in the rebate 8 and projects into the space 9.

Holes 12 are provided in the cover 6 for receiving the pins 10. Each pin has an annular groove 13, and when in the locked position, one edge of the bar 14 engages in the groove 13. To permit insertion and release of the pins 10 the bar 14 has notches 15 (See FIG. 1) which can be brought into register with the holes 12, so that there is no longer any retaining device in the grooves 13. With the bar 14 in this position, pins and therefore guns can be placed in or removed from the rack.

A peg (not shown) projects from the bar 14 through a slot in the cover 6 so as to facilitate raising and lowering of the bar.

When the bar 14 is slid down, to lock the pins, its bottom end can rest on a microswitch forming part of an alarm circuit and hold this in a closed position. If the bar is raised without first deenergising the alarm circuit, the microswitch will open to activate the alarm. A lock of the type having an axially movable pin can be used to lock the bar in its lower position.

In addition, suitable recesses can be machined in the lower half of the cover 6 to accommodate the microswitch and a key operated alarm on/off switch. This can be wired into a normal burglar alarm system so that in the event of the locking bar 14 being moved without first switching off the alarm, the alarm bell would sound.

Clearly, the rack can accommodate any number of guns, as desired.

The platform 2 has a part 2' which extends on the other side of the base 3. This part prevents a screwdriver being used to unscrew the screws 16 securing the trigger guard 17. If this was not done, it would be possible to remove these two screws 16, and then to wrench the gun from its place. A vertical extension to 2' prevents the stock of the gun being moved away from the wall to allow access to the screws.

I claim:

1. A rack for displaying and securing guns, which rack comprises a base having holes for receiving fastenings for securing the base to a wall, at least one gun support attached to the base for receiving and supporting a portion of a gun located adjacent the trigger guard, the at least one gun support extending underneath the gun so as to prevent access to screw , which secure the trigger guard to the gun, the holes in the base being inaccessible when a gun is in place on said at least one gun support, at least one recess in said base a locking pin which can be inserted through the trigger guard of the gun into said recess in the base, a longitudinally slidable locking bar for locking the pin in said recess, the pin having a head shaped so that the gun cannot be withdrawn over the head of the pin once the pin is locked in said recess.

2. The rack of claim 1, wherein the attachment of the at least one gun support includes a means for swivelling the gun support.

3. The rack of claim 1, wherein the base comprises a first member to be screwed to a wall, and a second, cover member which is secured to the first member by screws which attach the at least one gun support to the base.

4. The rack of claim 3, wherein the first member has a rebate along one edge and the cover member fits over the first member to leave a space extending along the rack adjacent the rebated edge, said rack having a plurality of said gun supports and locking pins received in a plurality of said recesses formed in said base, wherein the longitudinally slidable locking bar has notches cut out of one edge at regular intervals and is received partly in the rebate and partly in the space, the locking pins having lateral grooves at their ends which are to be inserted in said recesses in the base, so that the unnotched parts of the locking bar can engage in said grooves to lock the pins, and wherein the rack further comprises means for locking the bar against longitudinal movement.

5. The rack of claim 4 and including an alarm device operated by a micro-switch which is opened or closed by longitudinal movement of the locking bar.

* * * * *